US010259548B2

(12) United States Patent
Pan

(10) Patent No.: US 10,259,548 B2
(45) Date of Patent: Apr. 16, 2019

(54) SPLASH GUARD FOR SNORKEL TUBE

(71) Applicant: WATER SQUARE SPORTS CO., LTD., New Taipei (TW)

(72) Inventor: Chen-Lieh Pan, New Taipei (TW)

(73) Assignee: WATER SQUARE SPORTS CO., LTD., New Taipei (TW)

( * ) Notice: Subject to any disclaimer, the term of this patent is extended or adjusted under 35 U.S.C. 154(b) by 386 days.

(21) Appl. No.: 15/360,018

(22) Filed: Nov. 23, 2016

(65) Prior Publication Data

US 2018/0065720 A1 Mar. 8, 2018

(30) Foreign Application Priority Data

Sep. 5, 2016 (TW) ..... 105213607 U

(51) Int. Cl.
*B63C 11/16* (2006.01)
*B63C 11/20* (2006.01)

(52) U.S. Cl.
CPC ..... *B63C 11/207* (2013.01); *B63C 11/16* (2013.01)

(58) Field of Classification Search
CPC ..... B63C 11/207; B63C 11/16; B63C 1/00; B63C 11/00; B63C 11/02; B63C 11/18; B63C 11/20; B63C 11/205
USPC ..... 128/201.11
See application file for complete search history.

(56) References Cited

U.S. PATENT DOCUMENTS 7,165,545 B1 * 1/2007 Shiue ..... B63C 11/205 128/201.11
2005/0274380 A1 * 12/2005 Shiue ..... B63C 11/205 128/201.11
2008/0092883 A1 * 4/2008 Shiue ..... B63C 11/205 128/201.11

* cited by examiner

*Primary Examiner* — Jason E Flick
(74) *Attorney, Agent, or Firm* — Bacon & Thomas, PLLC

(57) ABSTRACT

A splash guard for a snorkel tube has an extension pipe, a pivot member pivotally mounted on the extension pipe, a space surrounded by the extension pipe and the pivot member, a float member pivotally mounted on the pivot member and located in the space, a closure member disposed on the pivot member, and a cover disposed on the extension pipe. The extension pipe has a first aperture and a second aperture in opposition. The pivot member has two pivot arms and a support portion. A pivoting limit is formed in a surface of the support portion facing the extension pipe which is selectively abutted by the float member. The closure member selectively seals the first aperture. The cover has a socket selectively engaged by the projection. The present invention can prevent inadequate sealing and has the advantages of light weight and small volume.

20 Claims, 14 Drawing Sheets

SPLASH GUARD FOR SNORKEL TUBE

CROSS-REFERENCE TO RELATED APPLICATION(S)

Pursuant to 35 U.S.C. § 119(a), this application claims the benefit of the priority to Taiwan Patent Application No. 105213607, filed Sep. 8, 2016. The content of the prior application is incorporated herein by its entirety.

BACKGROUND OF THE INVENTION

1. Technical Field of the Invention

The present invention relates to the field of snorkel equipment, specifically to a splash guard for preventing water from entering the snorkel tube.

2. Description of Related Art

Snorkel tubes are common tools allowing snorkelers to breathe beneath the water surface. A snorkel tube has a first opening and a second opening. The first opening is disposed above the water surface. The second opening is adapted to communicate with the mouth and nose of a snorkeler to maintain breathing. However, the fluctuation of the water surface, the splash of the water, or actions of the snorkeler may cause the water to enter the snorkel tube through the first opening and influence the breathing of the snorkeler. In view of this, a splash guard is usually mounted on the first opening of the snorkel tube to prevent the snorkeler from choking.

With reference to FIG. 13, a conventional splash guard 90 comprises an extension pipe 91, a pivot member 92, a float member 93, a closure ember 94, and a cover 95. The extension pipe 91 has a first aperture 911 and a second aperture (not shown) opposite the first aperture 911. The second aperture is connected to a snorkel tube 80. The pivot member 92 is pivotally mounted on the extension pipe 91 and between the first aperture 911 and the second aperture. The pivot member 92 has two pivot portions 921 and a support portion 922. One end of each pivot portion 921 is pivotally mounted on the extension pipe 91. The others end of the two pivot portions 921 are connected to each other and form the support portion 922. A pivoting limit 9221 extends from a surface of the support portion 922 facing the extension tube 91. The float member 93 is pivotally mounted on the other ends of the pivot portions 921. The closure member 94 is mounted on the support portion 922 on an end opposite the float member 93. The cover 95 is mounted on the extension pipe 91 and encloses the extension pipe 91, the pivot member 92, the float member 93, and the closure member 94.

With reference to FIGS. 13 and 14, under a first operation condition, the splash guard 90 for a snorkel tube is submerged beneath the water surface W with the first aperture 911 above the second aperture. The float member 93 is driven to pivot toward the pivoting limit 9221 of the support portion 922 by buoyant force. Following that, the float member 93 abuts the pivoting limit 9221 and pushes the pivot member 92 to pivot toward the first aperture 911 of the extension pipe 91. In the meanwhile, the closure member 94 pivots toward the first aperture 911 with the pivot member 92 to seal the first aperture 911 and prevents water from entering the snorkel tube 80.

Nevertheless, the conventional splash guard 90 for the snorkel. tube 80 may causes an inadequate sealing. For example, when the snorkeler breathes via the snorkel tube, a suction force is generated in the cover 95. If the suction force is strong enough, the pivot member 92 may be driven to pivot toward. the extension pipe 91 by the suction force. The closure member 94 will seal the first aperture 911 and block the communication between the extension pipe 91 and the exterior. Besides, exaggerative actions of the snorkeler may also result in the pivoting of the pivot member 92 and further making the closure member 94 seal the first aperture 911. The abovementioned situations may influence the breathing of the snorkeler and cause inconvenience.

To overcome the shortcomings, the present invention provides a splash guard for a snorkel tube to overcome the aforementioned problems.

SUMMARY OF THE INVENTION

The main objective of the invention is to provide a splash guard to overcome the inconvenience of the inadequate sealing of the conventional splash guard.

In accordance with an embodiment of the present invention, the splash guard comprises an extension pipe, a pivot member, a space, a float member, and a closure member. The extension pipe comprises a first aperture and a second aperture opposite the first aperture; the first aperture and the second aperture communicate with each other. The pivot member is pivotally mounted on the extension pipe and comprises two pivot arms and a support portion; each pivot arm has a first part pivotally mounted on the extension pipe and a second part being opposite the first part. The support portion is formed between the second parts of the pivot arms and has a pivoting limit protruded from a surface of the support portion facing the extension pipe and located between the pivot arms. The space is defined among the pivot arms, the support portion, and the extension pipe. The float member is pivotally mounted on the pivot member and is located in the space; a pivoting direction of the float member is opposite a pivoting direction of the pivot member; the float member selectively abuts the pivoting limit and has a projection protruding out of the float member. The closure member is disposed on the pivot member and selectively seals the first aperture. The cover is disposed on the extension pipe and encloses the extension pipe, the pivot member, the space, the float member, and the closure member. The cover has a socket selectively engaged by the projection.

Accordingly, the splash guard has advantages as follows:

First, the splash guard can prevent occurrence of the inadequate sealing by the engagement of the projection and the socket.

Second, the splash guard can be submerged beneath the water surface at an original state or upside down with the closure member sealing the first aperture to prevent the snorkeler from choking.

Third, the float member is light-weighted and small-volume so the splash guard is convenient to use.

In accordance with an embodiment of the present invention, the support portion has a bottom edge away from the closure member. A float limit is disposed between the bottom edge and the float member.

By the float limit, pivoting of the float member relative to the pivot member is limited to ensure the float member is located in the space.

In accordance with an embodiment of the present invention, the float limit is disposed on the float member. The float limit selectively abuts the bottom edge.

In accordance with an embodiment of the present invention, the float member comprises two opposite side surfaces, a peripheral surface, a recess, and a pivot plate. The peripheral surface is formed between the side surfaces; the recess is defined in one of two side surfaces; the pivot plate is pivotally mounted in the recess and has the projection.

In accordance with an embodiment of the present invention, the recess has an upper edge and a lower edge. The upper edge and the lower edge are located on opposite edges of the recess. The pivot plate selectively abuts the upper edge or the lower edge.

In accordance with an embodiment of the present invention, the closure member has a closure body and an assembly portion. The closure body has a clos e surface which selectively seals the first aperture; the assembly portion is formed on a surface opposite the closure surface of the closure body; the assembly portion is disposed on the pivot member.

In accordance with an embodiment of the present invention, the support portion has a mounting tab formed on and protruding from the support portion; the closure member is mounted on the mounting tab; a hole is defined in the mounting tab; a shrunk part is shrunk radially from a part of the assembly portion; the shrunk part is disposed through the hole.

In accordance with an embodiment of the present invention, the extension pipe has a mounting wan surrounding the side wall and abutted by the cover and two mounting pins respectively disposed on two opposite sides of the mounting wall. The cover has two mounting holes through which the mounting pins are mounted.

In accordance with an embodiment of the present invention, the cover has multiple orifices defined in the cover and communicating with the first aperture of the extension pipe.

Other objectives, advantages, and novel features of the embodiments of the present invention will become more apparent from the following detailed description when taken in conjunction with the accompanying drawings.

BRIEF DESCRIPTION OF THE REFERRED EMBODIMENT

DETAILED DESCRIPTION

Figure 1:
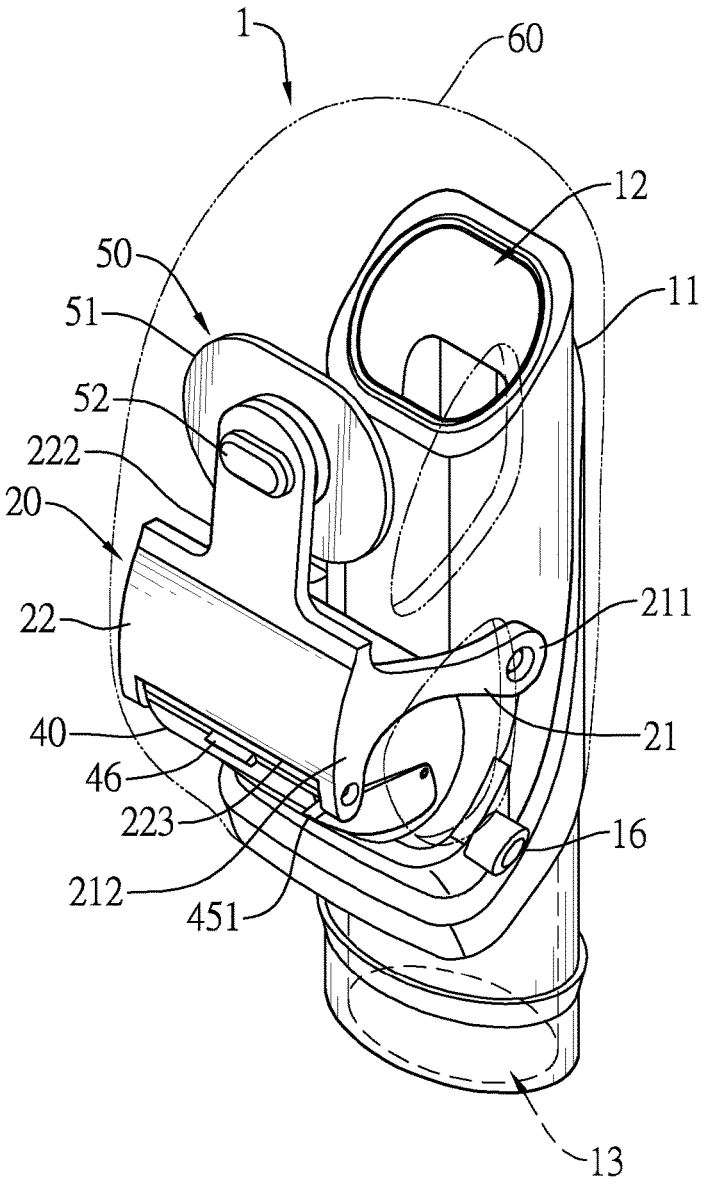
FIG. 1 is a front perspective view of a splash guard of the present invention.
Figure 2:
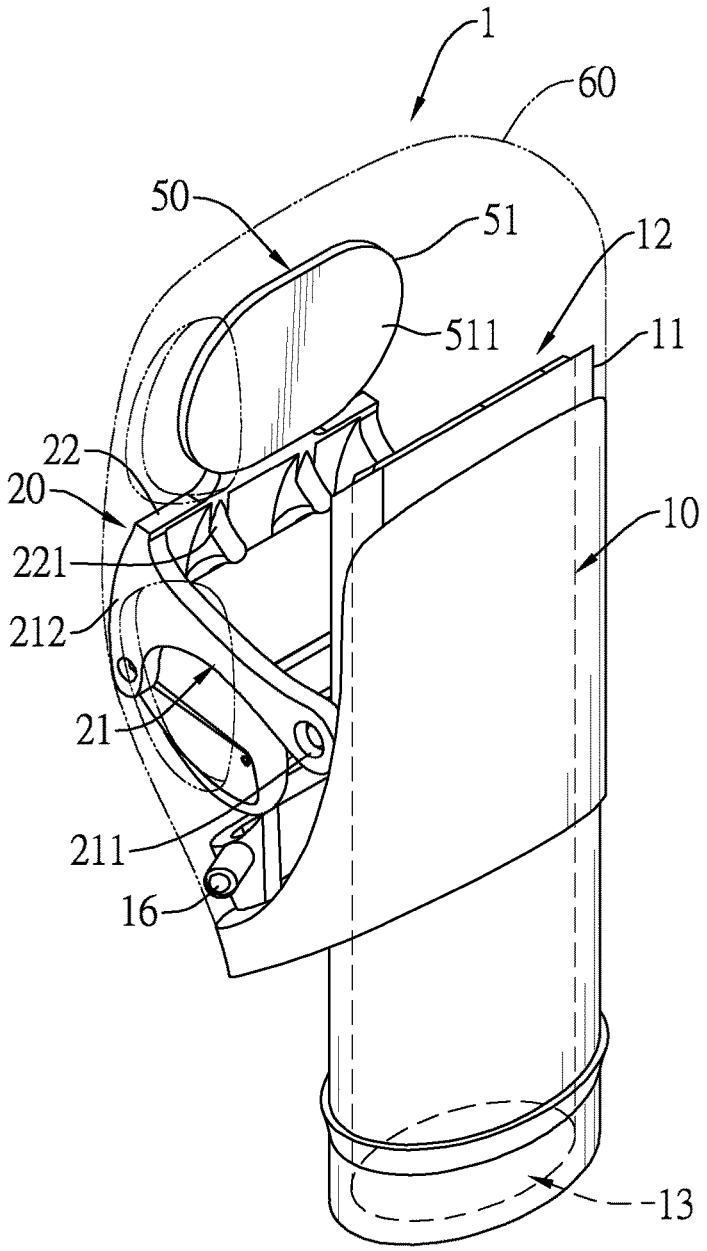
FIG. 2 is a back perspective view of the splash guard.
Figure 3:
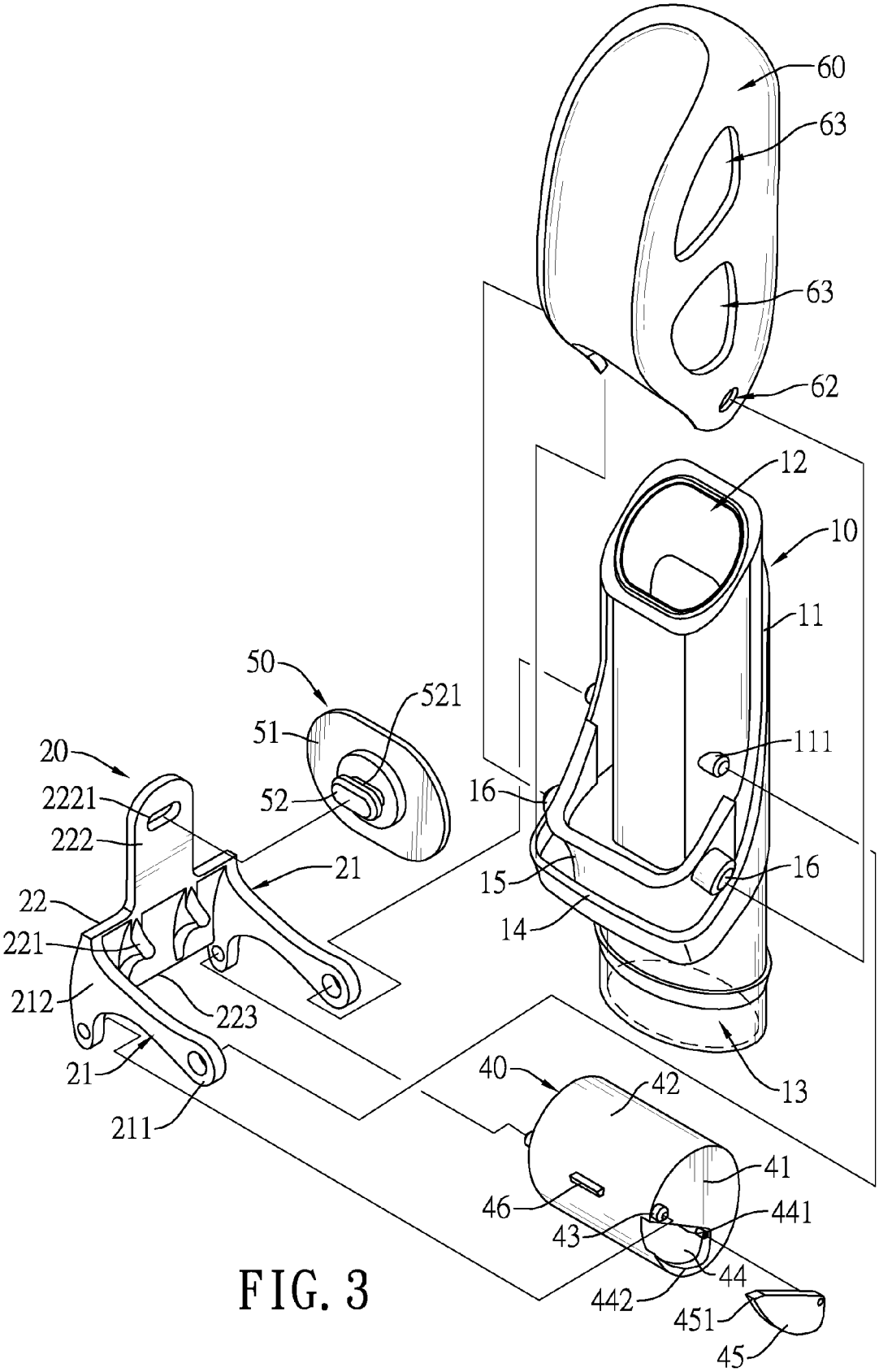
FIG. 3 is an exploded perspective view of the splash guard.

With reference to FIGS. 1 to 4, a splash guard 1 of the present invention comprises an extension pipe 10, a pivot member 20, a space 30, a float member 40, a closure member 50, and a cover 60.

The extension pipe 10 comprises a side wall 11, a first aperture 12, a second aperture 13, a holding wall 14, a mounting wall 15, and two mounting pins 16.

The side wall 11 has two pivots 111. The pivots 111 extend laterally and oppositely outward from the side wall 11.

The first aperture 12 and the second aperture 13 are formed respectively at opposite ends of the side wall 11. The first aperture 12 and the second aperture 13 communicate with each other. The pivots 111 are disposed between the first aperture 12 and the second aperture 13.

The holding wall 14 is formed on and partially surrounds the side wall 11.

The mounting wall 15 is formed on and partially surrounds the side wall 11. The mounting wall 15 is closer to the first aperture 12 than the holding wall 14.

The mounting pins 16 are respectively disposed on two opposite sides of the mounting wall 15. Specifically, the mounting pins 16 are closer to the second aperture 13 than the pivots 111.

The pivot member 20 is pivotally mounted on the extension pipe 10. The pivot member 20 has two pivot arms 21 and a support portion 22.

Each pivot arm 21 has a first part 211 and a second part 212 which are located respectively on two opposite ends of the pivot aria 20. The first parts 211 of the pivot arms 21 are pivotally mounted on the extension pipe 10. Specifically, the first parts 211 of the pivot arras 21 are disposed on the pivots 111 respectively.

The support portion 22 is formed between the second parts 212 of the pivot arms 21. The support portion 22 has a pivoting limit 221, a mounting tab 222, and a bottom edge 223. The pivoting limit 221 extends from a surface of the support portion 22 that faces the extension pipe 10. The pivoting limit 221 is located between the pivot arms 21. The mounting tab 222 and the bottom edge 223 are opposite each other on the support portion 22. The mounting tab 222 is closer to the first aperture 13 than the bottom edge 223. The mounting tab 222 has a hole 2221. The hole 2221 is formed through the mounting tab 222.

The space 30 is defined among the pivot arms 21, the support portion 22, and the side wall 11 of the extension pipe 10.

The float member 40 is pivotally mounted on the pivot member 20 and located in the space 30. A diameter of the float member 40 is shorter than the length of the pivot arms 21 to make the space 30 able to accommodate the float member 40. The float member 40 selectively abuts the pivoting limit 221 to limit a pivot angle of the float member 40 closer to the pivoting limit 221. A density of the float member 40 is less than 1. The float member 40 has two side surfaces 41, a peripheral surface 42, two pivot shafts 43, a recess 44, a pivot plate 45, and a float limit 46.

The side surfaces 41 are opposite each other.

The peripheral surface 42 is formed between the side surfaces 41.

In the embodiment, the pivot shafts 43 are respectively projected from the side surfaces 41 of the float member 40. The pivot shafts 43 are respectively pivotally mounted on the second parts 212 of the pivot arms 21.

The recess 44 is defined in one of the two side surfaces 41. The recess 44 has an upper edge 441 and a lower edge 442. The upper edge 441 and the lower edge 442 are located on opposite edges of the recess 44.

The pivot plate 45 is pivotally mounted in the recess 44. The pivot plate 45 selectively abuts the upper edge 441 or the lower edge 442. The pivot plate 45 has a projection 451. The projection 451 protrudes out of the recess 44 and protrudes out of the peripheral surface 42 of the float member 40.

The float limit 46 is disposed on the peripheral surface 42 of the float member 40. The float limit 46 selectively abuts the bottom edge 223 of the support portion 22 to limit the pivot angle of the float member 40 away from. the pivoting limit 221. Therefore, the float member 40 is always located in the space 30.

In another embodiment, the float limit 46 is disposed on the bottom edge 223 of the support portion 22 and extends in a direction opposite the mounting tab 222. The float member 40 selectively abuts the float limit 46 to limit the pivot angle of the float member 40 away from the pivoting limit 221.

When the float member 40 is driven to pivot by buoyant force and/or gravity, the pivot member 20 may also be driven to pivot by buoyant force and/or gravity. A pivoting direction of the float member 40 and a pivoting direction of the pivot member 20 are opposite. The pivot member 20 may be imposed by a torque on the fulcrum of the first parts 211 of the pivot arms 21. A lever arm. of the torque is equivalent to a length of the pivot arms 21.

The closure member 50 is disposed on the pivot member 20. Specifically, the closure member 50 is disposed on the mounting tab 222 of the support portion 22 and away from the bottom edge 223. The closure member 50 selectively seals the first aperture 12. In the embodiment, the closure member 50 is made of soft materials. The closure member 50 has a closure body 51 and an assembly portion 52.

The closure body 51 has a closure surface 511. The closure surface 511 selectively seals the first aperture 12.

The assembly portion 52 is formed on a surface of the closure body 51 that is opposite the closure surface 511. The assembly portion 52 is disposed on the pivot member 20. The assembly portion 52 has a shrunk part 521. The shrunk part 521 is shrunk radially from a part of the assembly portion 52. The shrunk part 521 is disposed through the hole 2221 of the mounting tab 222 to fix the closure member 50 on the mounting tab 222.

The cover 60 is disposed on the mounting pins 16 of the extension pipe 10. Specifically, the cover 60 abuts the holding wall 14 so the cover 60 is unable to pivot relative to the extension pipe 10. The cover 60 encloses the extension pipe 10, the pivot member 20, the space 30, the float member 40, and the closure member 50. The cover 60 has a socket 61, two mounting holes 62, and multiple orifices 63.

The socket 61 is defined in a surface of the cover 60 that faces the extension pipe 10. The socket 61 is selectively engaged by the projection 451 of the pivot plate 45. When the splash guard 1 is upon a water surface W, an engagement between the socket 61 and the projection 451 can prevent the pivot member 20 from pivoting relative to the extension pipe 10 due to suction force or exaggerative actions of the snorkeler. Further, the closure member 50 will not pivot to seal the first aperture 12 of the extension pipe 10. Therefore, the breathing of the snorkeler will not be influenced.

The mounting holes 62 are formed on the cover 60 and the mounting pins 16 are disposed through the mounting holes 62.

The multiple orifices 63 are formed on the cover 60 and communicate with the first aperture 12 of the extension pipe 10 to provide fresh air to the snorkeler.

Side views of a first operation condition of the splash guard 1 connected to a snorkel tube 80 are shown in FIGS. 4 to 10. Under the first operation condition, an angle between the side wall 11 and the water surface W shown in FIGS. 5 to 10 is, but not limited to, 90°. In another embodiment, the angle $\alpha$ between the side wall 11 and the water face W is between 0° to 90° under the first operation condition.

Figure 4:
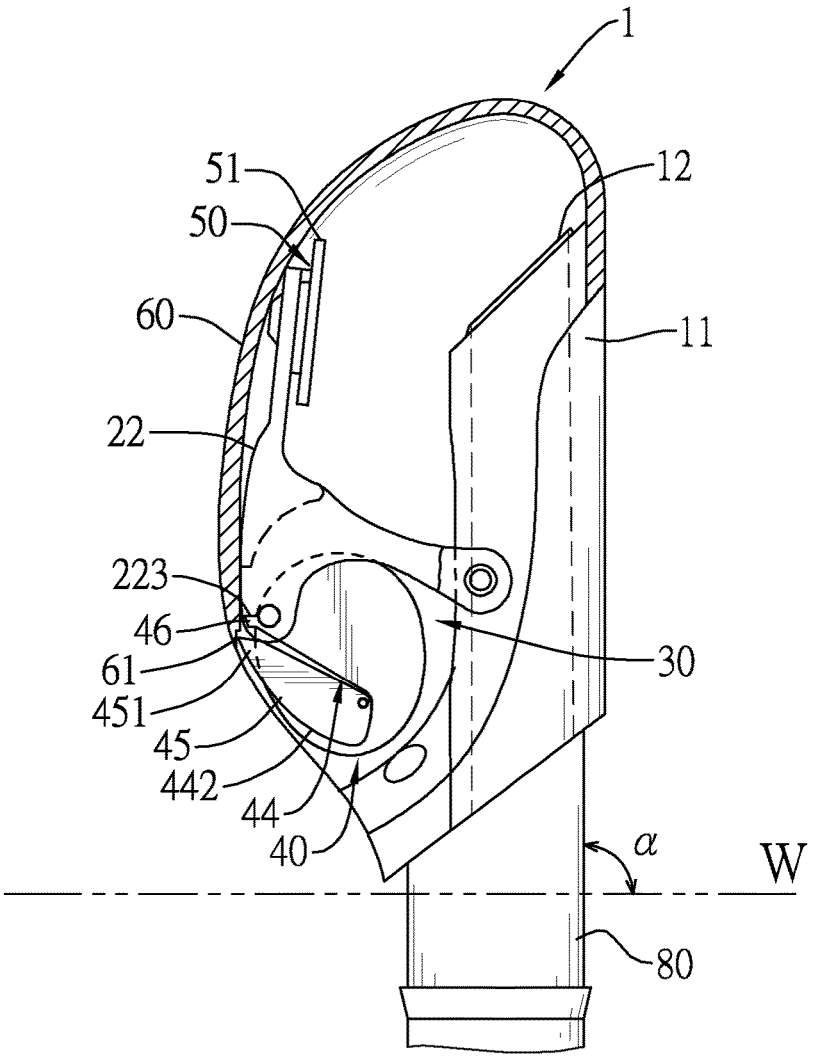
FIG. 4 is a sectional side view in partial section of the splash guard.

With reference to FIG. 4, the splash guard 1 at an original state is upon the water surface W. The pivot plate 45 abuts the lower edge 442 of the recess 44. The projection 451 of the pivot plate 45 engages with the socket 61 of the cover 60. The float limit 46 abuts the bottom edge 223 of the support portion 22. The float member 40 is located in the space 30. Therefore, the closure surface 511 of the closure body 51 does not seal the first aperture 12 due to suction force or the exaggerative actions of the snorkeler.

Figure 5:
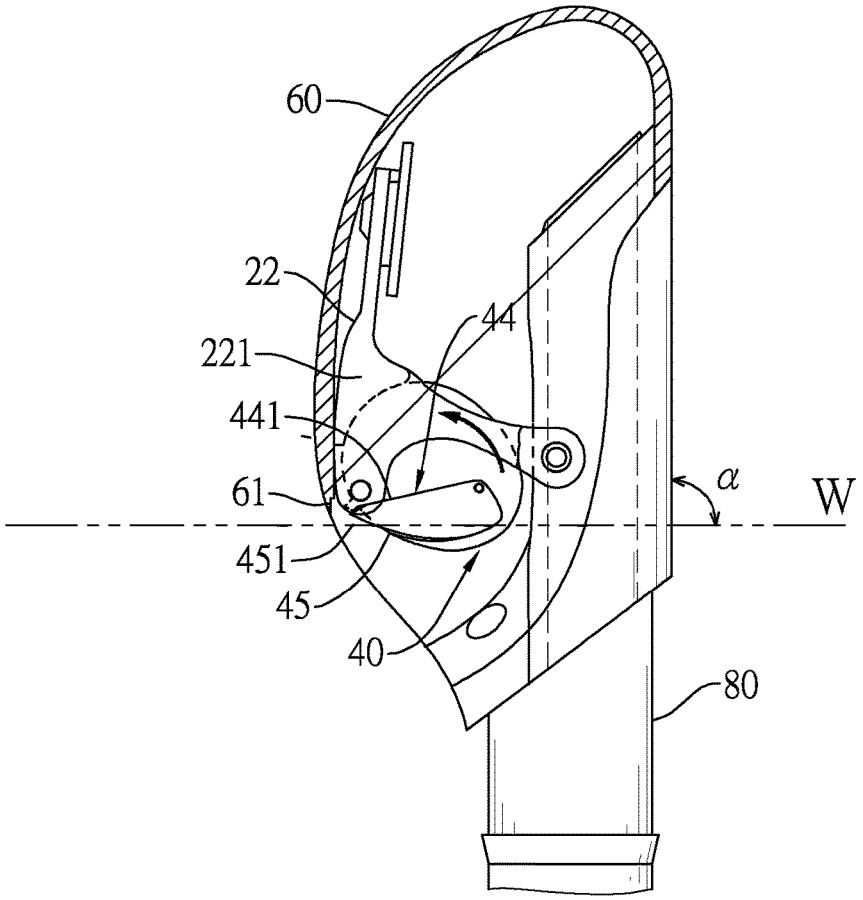
FIG. 5 is a first operational side view in partial section of the splash guard shown in FIG. 4 under a first operation condition.
Figure 6:
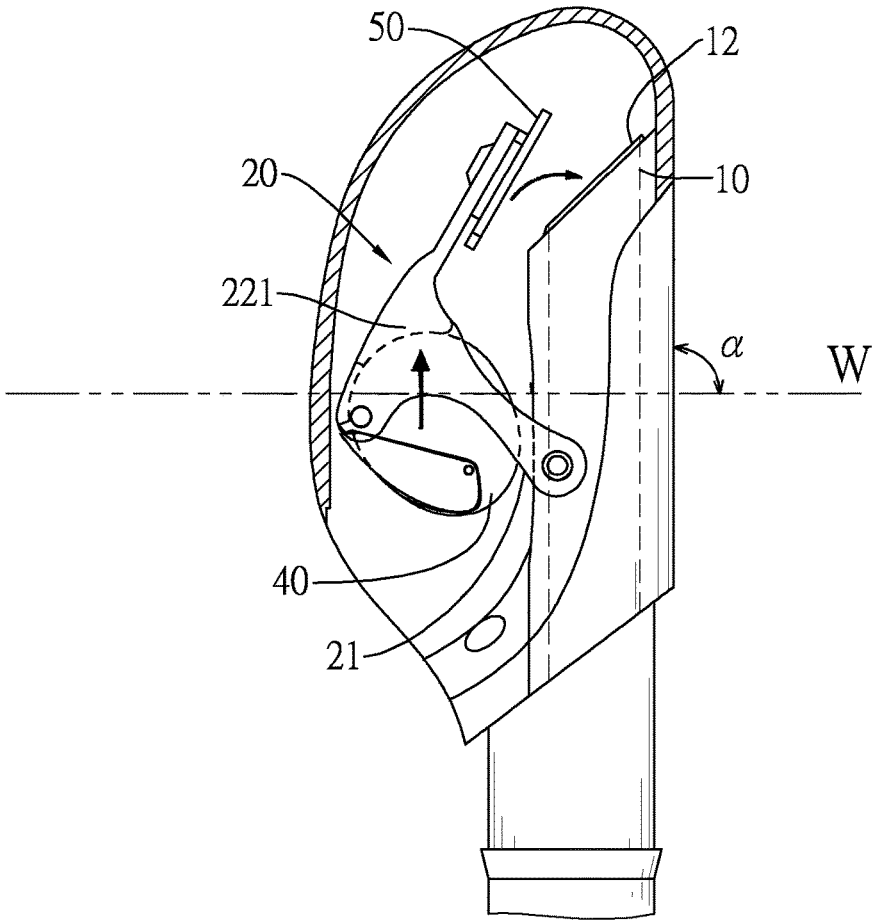
FIG. 6 is a second operational side view in partial section of the splash guard shown in FIG. 4 under the first operation condition.

With reference to FIG. 5, the float member 40 is submerged beneath the water surface W slightly. The float member 40 is driven to pivot counterclockwise and abuts the pivoting limit 221 by buoyant force. The projection 451 of the pivot plate 45 disengages from the socket 61 of the cover 60 due to pivoting of the float member 40. The pivot plate 45 pivots closer and abuts the upper edge 441 of the pivot plate 45 as shown in FIG. 6.

Following, when the float member 40 is further submerged beneath the water surface W, the float member 40 is imposed by larger buoyant force. The float member 40 further pushes the pivot member 20 through the pivoting limit 221 and the pivot member 20 is driven to pivot closer to the first aperture 12. That is, the closure member 50 moves toward the first aperture 12.

Figure 7:
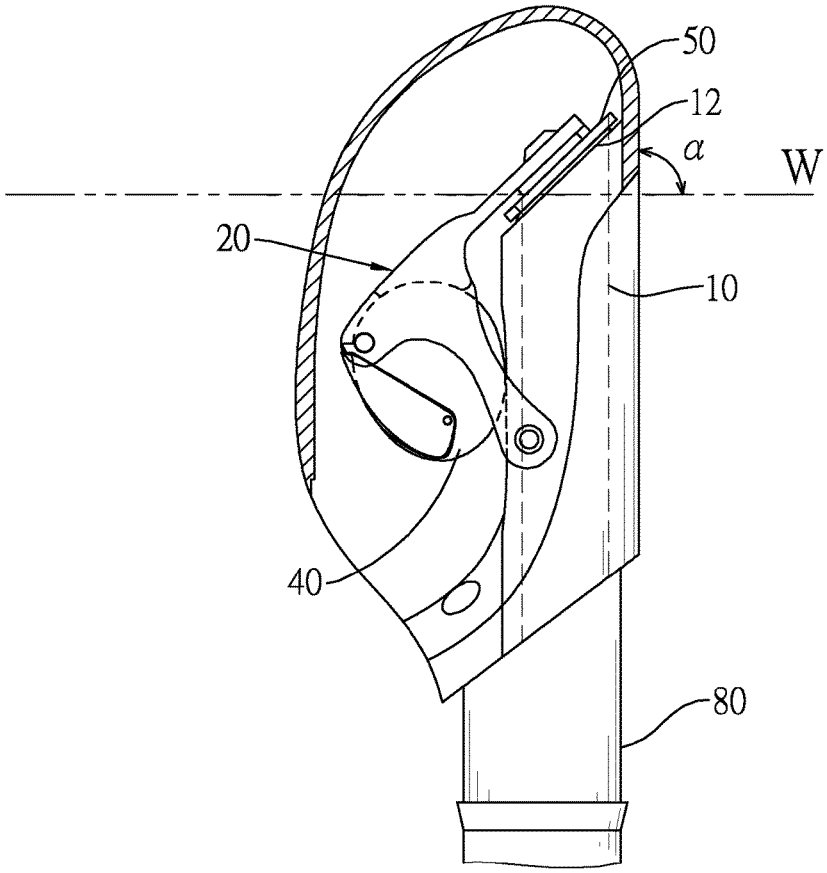
FIG. 7 is a third operational side view in partial section of the splash guard shown in FIG. 4 under the first operation condition.

With reference to FIG. 7, when the float member 40 is totally submerged beneath the water surface W, the float member 40 is imposed by much larger buoyant force to make the closure member 50 seal the first aperture 12. Therefore, when the splash guard 1 is beneath the water surface W, the closure member 50 seals the first aperture 12 to prevent water from entering the snorkel tube 80 and choking the snorkeler.

Figure 8:
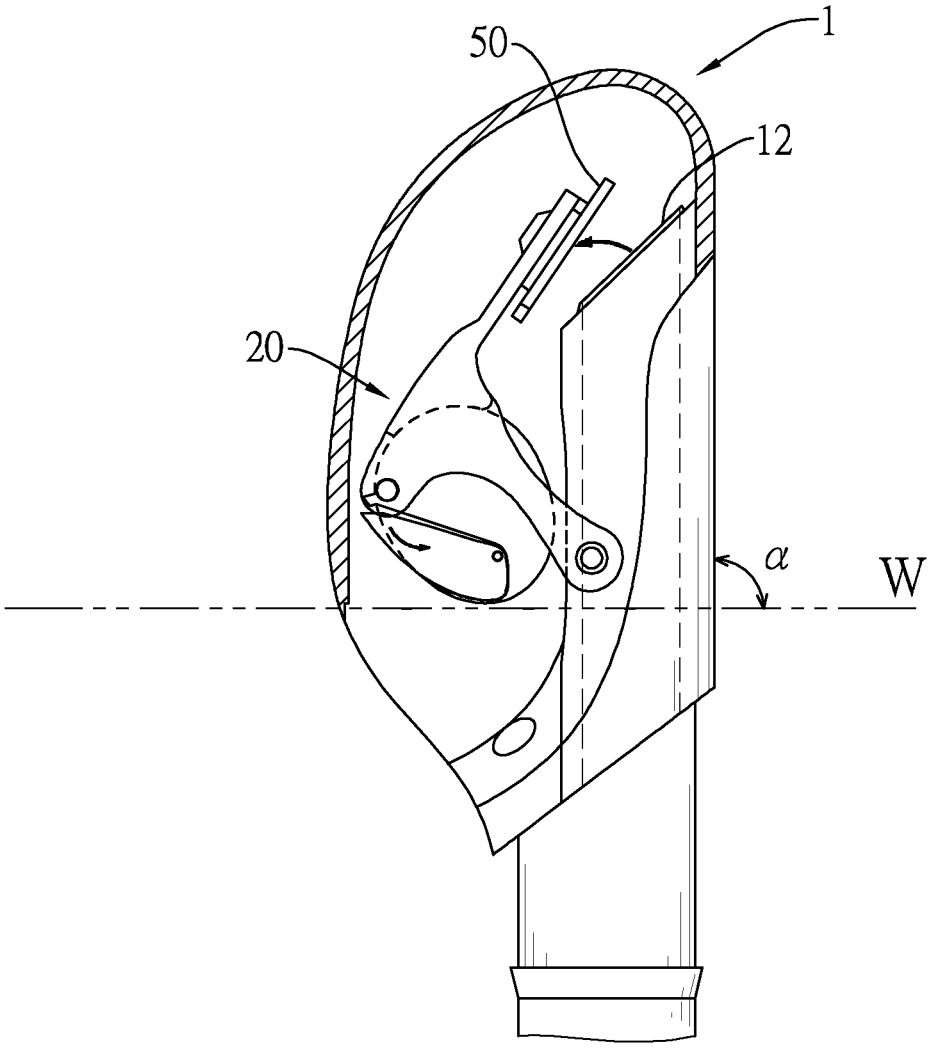
FIG. 8 is a fourth operational side view in partial section of the splash guard shown in FIG. 4 under the first operation condition.

With reference to FIG. 8, when the splash guard 1 emerges from the water surface W, the pivot member 20 unseals the first aperture 12 due to gravity.

Figure 9:
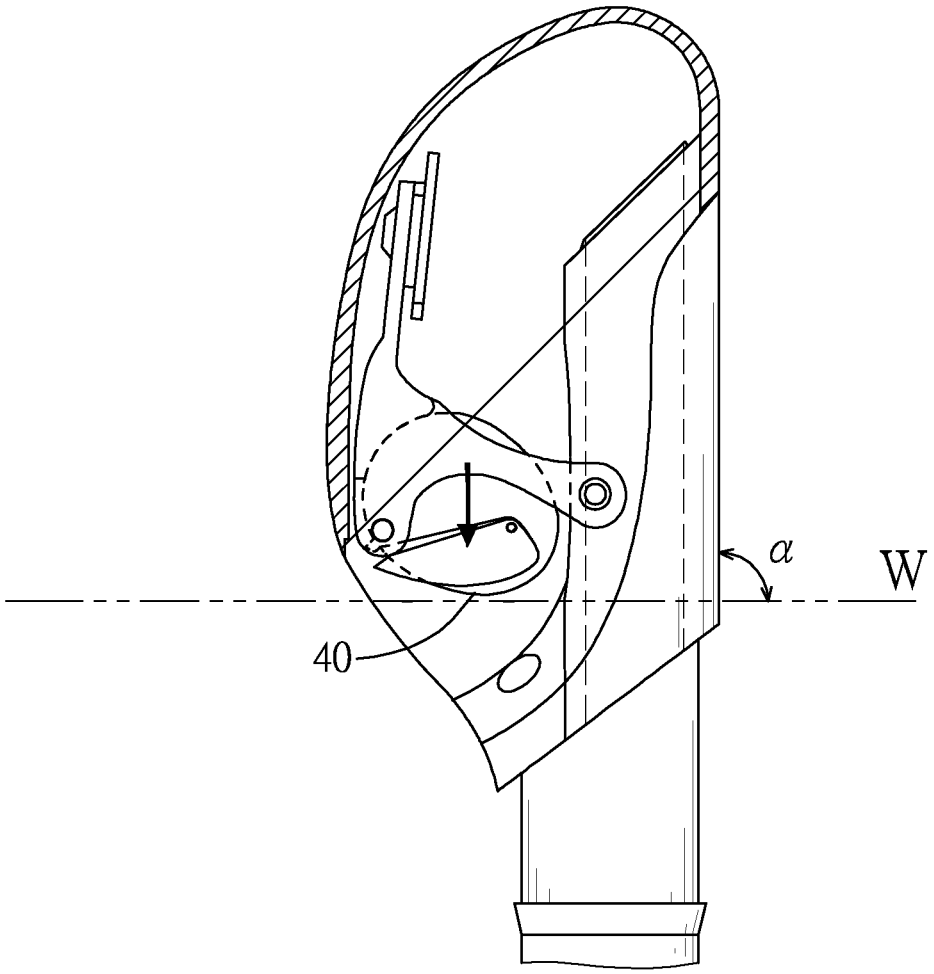
FIG. 9 is a fifth operational side view in partial section of the splash guard shown in FIG. 4 wider the first operation condition.

With reference to FIG. 9, when the splash guard 1 further emerges from the water surface W, the pivot member 20 pivots away from the first aperture 12 due to gravity.

Figure 10:
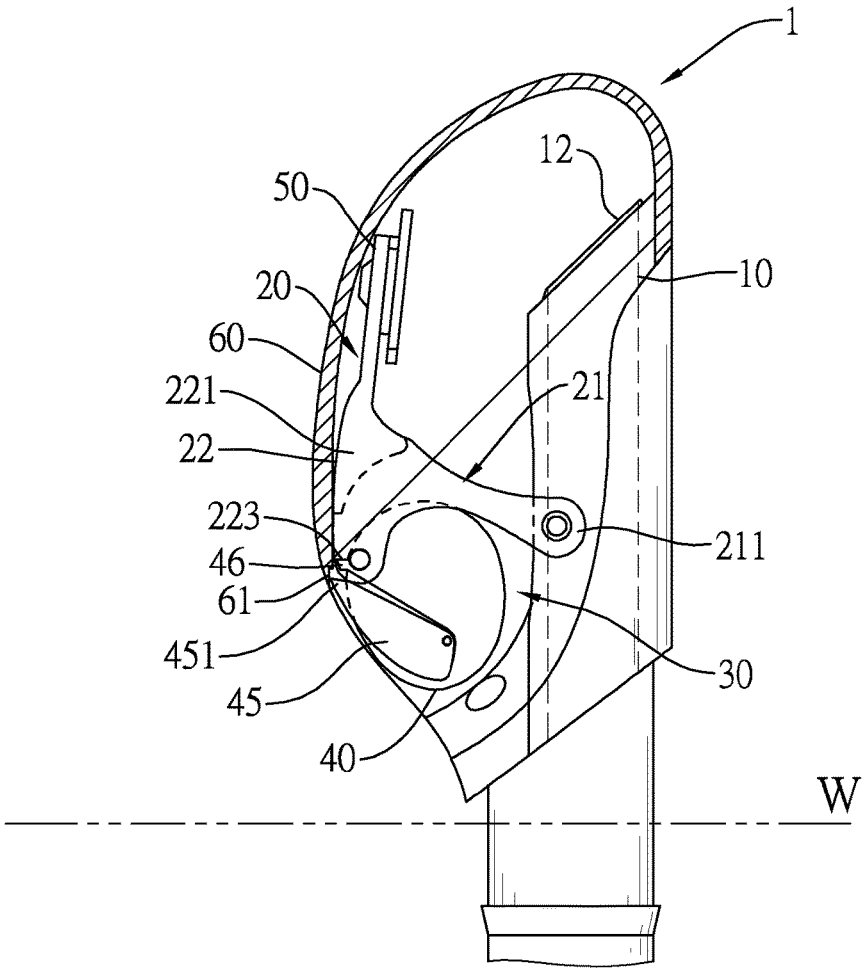
FIG. 10 is a sixth operational side view in partial section of the splash guard shown in FIG. 4 under the first operation condition.

With reference to FIG. 10, when the splash guard 1 totally emerges from the water surface W, the float member 40 pivots away from the pivoting limit 221. The float limit 46 abuts the bottom edge 223 of the support portion 22. The projection 451 of the pivot plate 45 engages with the socket 61 of the cover 60. Finally, the splash guard 1 will return to the original state shown in FIG. 4.

With reference to FIGS. 5 to 10, under the first operation condition, the pivoting direction of the float member 40 is opposite the pivoting direction of the pivot member 20. The splash guard 1 can prevent the snorkeler from choking by sealing the first aperture 12 with the closure member 50. The float member 40 is driven to pivot relative to the extension pipe 10 by buoyant force and/or gravity. When the float member 40 pivots to abut the pivoting limit 221, the pivot member 20 is pushed by the float member 40 and pivots toward the first aperture 12. Therefore, the closure member 50 can seal the first aperture 12.

Besides, under a second operation condition of the splash guard 1, the closure member 50 does not seal the first aperture 12 due to the suction force or the exaggerative actions of the snorkeler.

Figure 11:
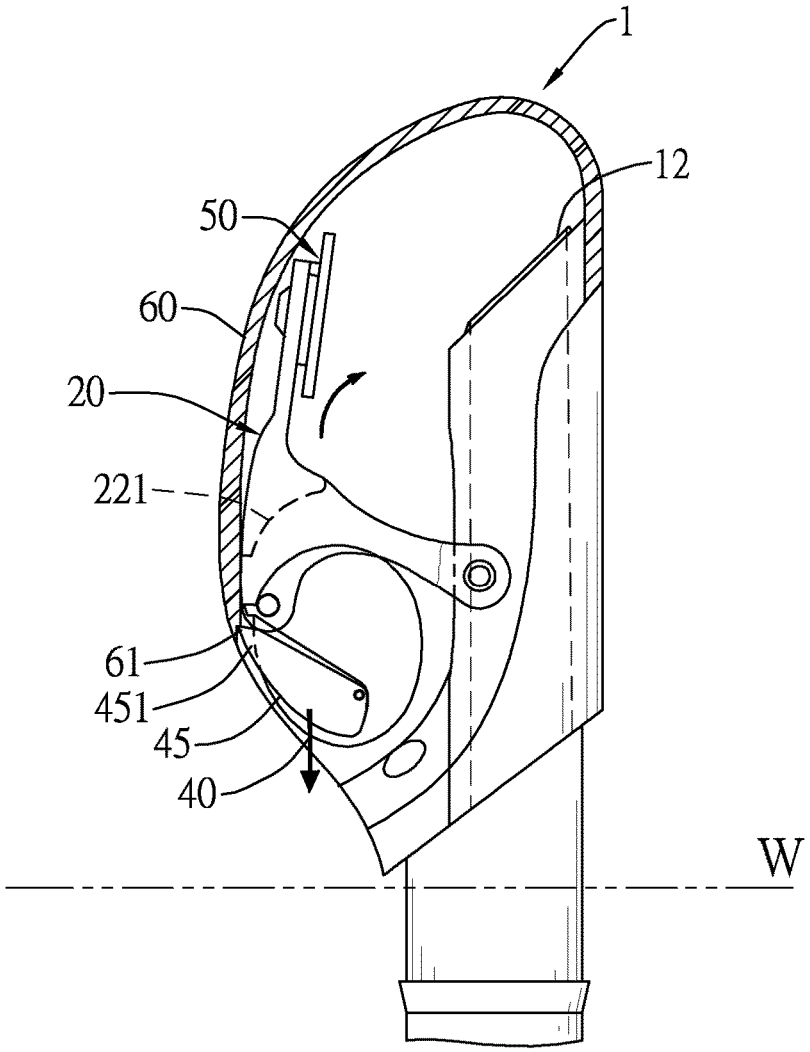
FIG. 11 is an operational side view in partial section of the splash guard shown in FIG. 4 under a second operation condition.

With reference to FIG. 10, the splash guard 1 is located upon the water surface W. In other words, the float member 40 is only influenced by gravity. The projection 451 of the pivot plate 45 engages with the socket 61 of the cover 60 because the projection 451 protrudes out of the float member 40. Under the second operation condition, if the snorkeler breathes or shakes his head, the float member 40 will pivot toward pivoting limit 221 slightly. However, due to the engagement between the socket 61 and the projection 451, the float member 40 does not pivot closer and abut the pivoting limit 221 as shown in FIG. 11.

Due to limitation of the pivot angle of the float member 40, the float member 40 cannot pivot to abut the pivoting limit 221. The pivot member 20 will not be pushed by the float member 40 and pivot toward the first aperture 12 at a large angle. That is, due to the engagement between the projection 451 and the socket 61, the closure member 50 does not seal the first aperture 12 under the second operation condition. The present invention can solve the problems of the conventional splash guard and the snorkeler will not breathe difficultly under the second operation condition.

Figure 12:
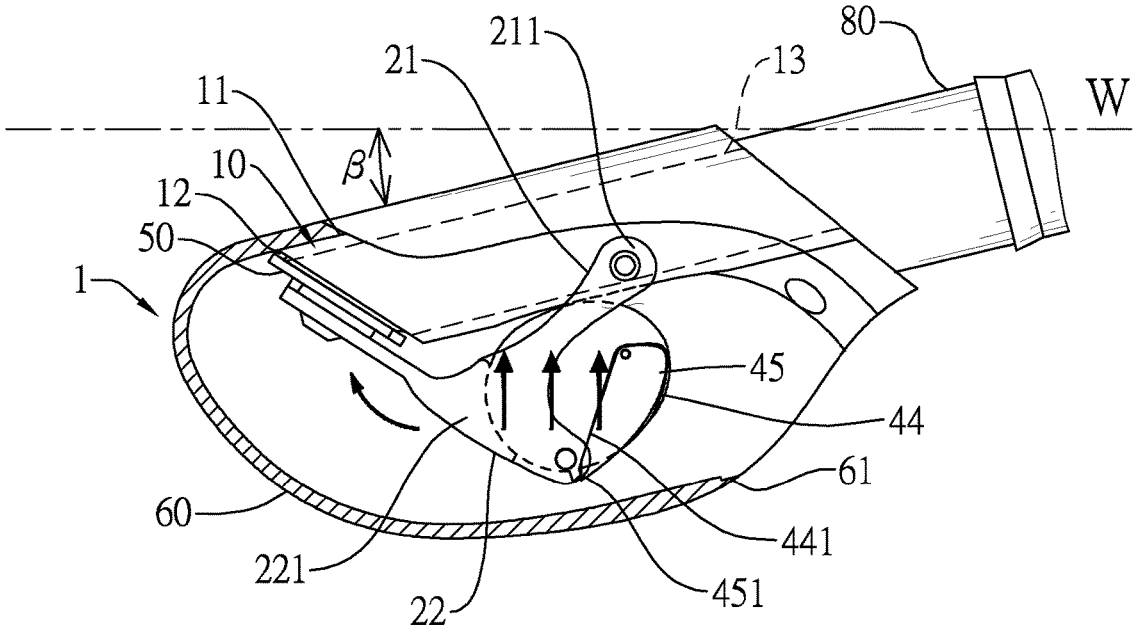
FIG. 12 is an operational side view in partial section of the splash guard shown in FIG. 4 under a third operation condition.
Figure 13:
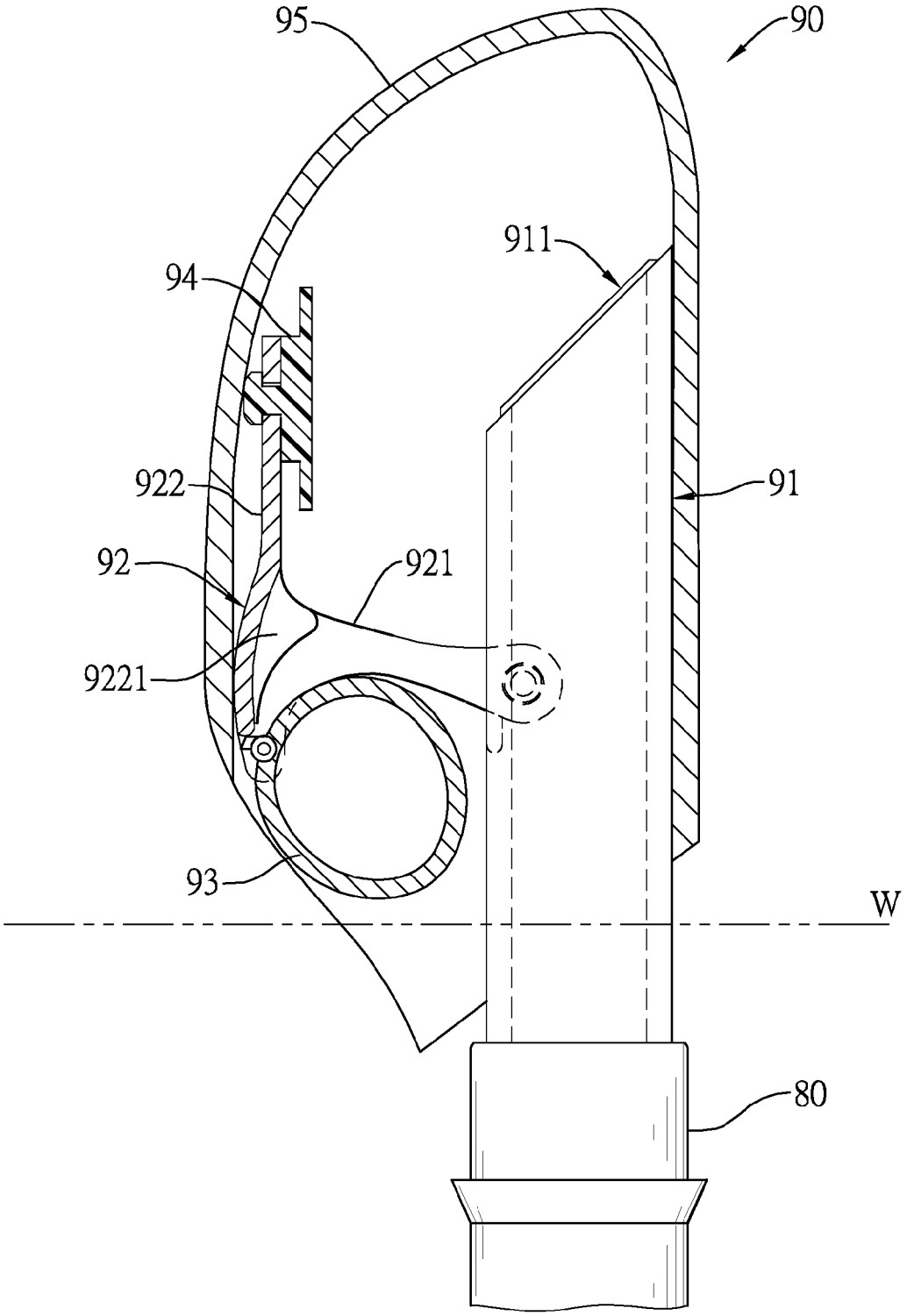
FIG. 13 PRIOR ART
FIG. 13 is a first operational side view in partial section of a conventional splash guard in accordance with the prior art under the first operation condition.
Figure 14:
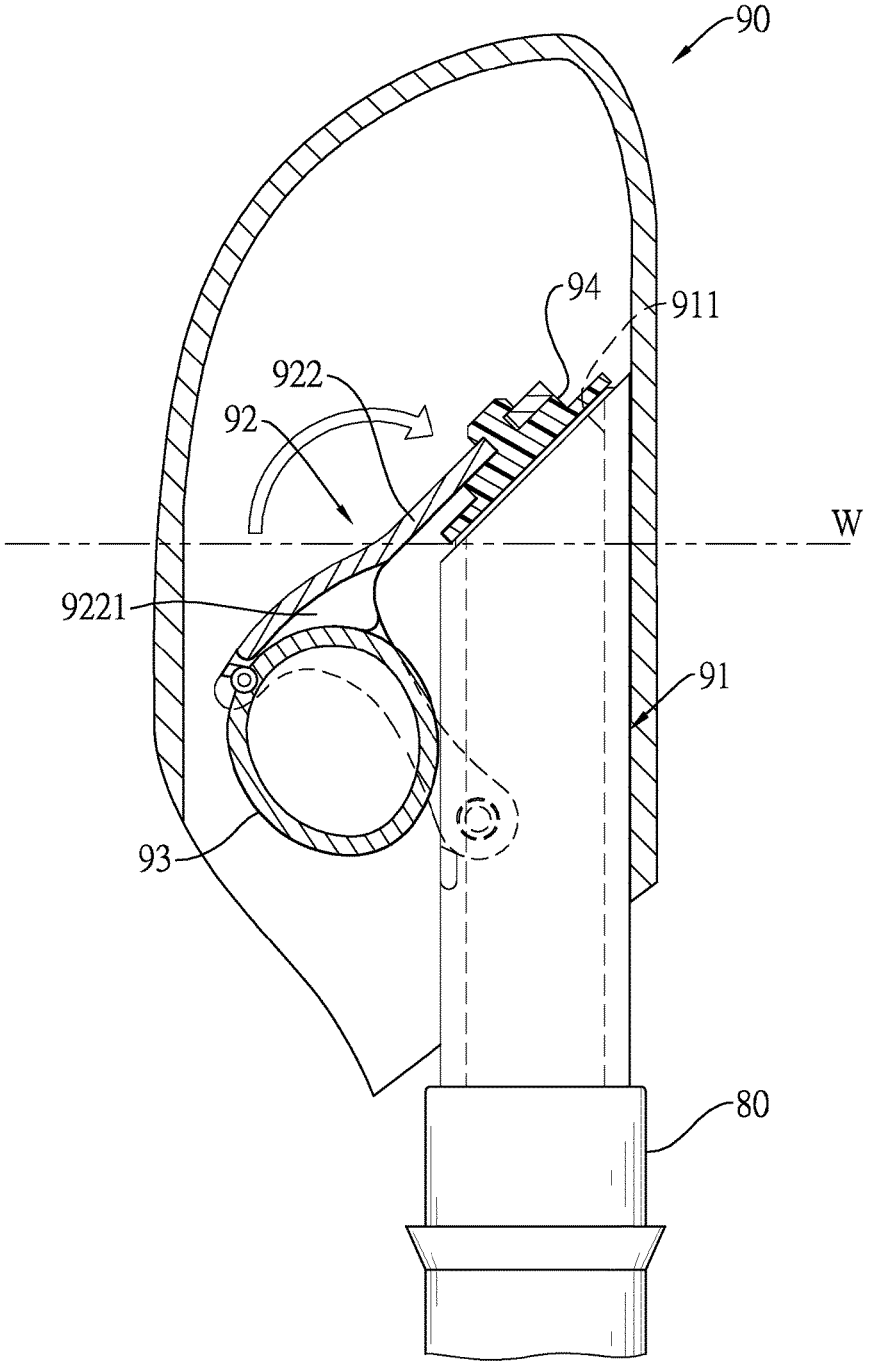
FIG. 14 PRIOR ART
FIG. 14 is a second operational side view in partial section of a conventional splash guard in accordance with the prior art under the first operation condition.

With reference to FIG. 12, under a third operation condition, the splash guard 1 is submerged beneath the water surface W upside down. That is, the first aperture 12 is farther from the water surface W than the second aperture 13. An angle β is formed between the side wall 11 and the water surface W. The angle β is beneath the water surface W under the third operation condition while the angle α is upon the water surface W under the first operation condition. Therefore, the angle β under the water surface W is a negative angle while the angle a upon the water surface W is a positive angle.

In sum, the splash guard 1 can prevent the closure member 50 from sealing the first aperture 12 due to the inhalation or the actions of the snorkeler. Besides, the splash guard 1 is light-weighted and small-volume and therefore is convenient to use and carry. Moreover, regardless that the splash guard 1 is submerged beneath the water surface W at an original state or upside down, the splash guard 1 always prevents water from entering the snorkel tube 80. Therefore, the splash guard 1 has advantages of convenience, comfort, and safety.

What is claimed is:

1. A splash guard comprising:

an extension pipe comprising a first aperture and a second aperture opposite the first aperture, wherein the first aperture and the second aperture communicate with each other;

a pivot member pivotally mounted on the extension pipe and comprising two pivot arms each having a first part pivotally mounted on the extension pipe; and a second part opposite the first part; and a support portion formed between the second. parts of the pivot arms and having a pivoting limit formed on a surface of the support portion facing the extension pipe and between the pivot arms;

a space defined among the pivot arms, the support portion, and the extension pipe;

a float member pivotally mounted on the pivot member and located in the space; a pivoting direction of the float member being opposite a pivoting direction of the pivot member; the float member selectively abutting the pivoting limit and having a projection protruding out of the float member;

a closure member disposed on the pivot member and selectively sealing the first aperture; and a cover disposed on the extension pipe and enclosing the extension pipe, the pivot member, the space, the float member, and the closure member; the cover having a socket selectively engaged with the projection.

2. The splash guard as claimed in claim 1, wherein the support portion has a bottom edge which is away from the closure member; and a float limit is disposed between the bottom edge and the float member.

3. The splash guard as claimed in claim 2, wherein the float limit is disposed on the float member; and the float limit selectively abuts the bottom edge.

4. The splash guard as claimed in claim 1, wherein the float member comprises two opposite side surfaces;

a peripheral surface formed between the side surfaces;

a recess defined in one of the two side surfaces; and a pivot plate pivotally mounted in the recess and having the projection.

5. The splash guard as claimed in claim 2, wherein the float member comprises two opposite side surfaces;

a peripheral surface formed between the side surfaces;

a recess defined in one of the two side surfaces; and a pivot plate pivotally mounted in the recess and having the projection.

6. The splash guard as claimed in claim 3, wherein the float member comprises two opposite side surfaces;

a peripheral surface formed between the side surfaces;

a recess defined in one of the two side surfaces; and a pivot plate pivotally mounted in the recess and having the projection.

7. The splash guard as claimed in claim 4, wherein the recess has an upper edge and a lower edge;

the upper edge and the lower edge are located respectively on opposite edges of the recess; and the pivot plate selectively abuts the upper edge or the lower edge.

8. The splash guard as claimed in claim 5, wherein the recess has an upper edge and a lower edge;

the upper edge and the lower edge are located respectively on opposite edges of the recess; and the pivot plate selectively abuts the upper edge or the lower edge.

9. The splash guard as claimed in claim 6, wherein the recess has an upper edge and a lower edge;

the upper edge and the lower edge are located respectively on opposite edges of the recess; and the pivot plate selectively abuts the upper edge or the lower edge.

10. The splash guard as claimed in claim 1, wherein the closure member has a closure body having a closure surface which selectively seals the first aperture; and an assembly portion formed on a surface that is opposite the closure surface of the closure body; the assembly portion disposed on the pivot member.

11. The splash guard as claimed in claim 2, wherein the closure member has a closure body having a closure surface which selectively seals the first aperture; and an assembly portion formed on a surface that is opposite the closure surface of the closure body; the assembly portion disposed on the pivot member.

12. The splash guard as claimed in claim 3, wherein the closure member has a closure body having a closure surface which selectively seals the first aperture; and an assembly portion formed on a surface that is opposite the closure surface of the closure body; the assembly portion disposed on the pivot member.

13. The splash guard as claimed in claim 8, wherein the support portion has a mounting tab formed on and protruding from the support portion;

the closure member is mounted on the mounting tab;

a hole is defined in the mounting tab;

a shrunk part is shrunk radially from a part of the assembly portion; and the shrunk part is disposed through the hole.

14. The splash guard as claimed in claim 9, wherein the support portion has a mounting tab formed on and protruding front the support portion;

the closure member is mounted on the mounting tab;

a hole is defined in the mounting tab;

a shrunk part is shrunk radially from a part of the assembly portion; and the shrunk part is disposed through the hole.

15. The splash guard as claimed in claim 10, wherein the support portion has a mounting tab formed on and protruding from the support portion;

the closure member is mounted on the mounting tab;

a hole is defined in the mounting tab;

a shrunk part is shrunk radially from a part of the assembly portion; and the shrunk part is disposed through the hole.

16. The splash guard as claimed in claim 1, wherein the extension pipe has a mounting wall surrounding the side wall and abutted by the cover and two mounting pins respectively disposed on two opposite sides of the mounting wall; and the cover has two mounting holes through which the mounting pins are mounted.

17. The splash guard as claimed in claim 2, wherein the extension pipe has a mounting all surrounding the side wall and abutted by the cover and two mounting pins respectively disposed on two opposite sides of the mounting wall; and the cover has two mounting holes through which the mounting pins are mounted.

18. The splash guard as claimed in claim 1, wherein the cover has multiple orifices defined in the cover and communicating with the first aperture of the extension pipe.

19. The splash guard as claimed in claim 2, wherein the cover has multiple orifices formed on the cover and communicating with the first aperture of the extension pipe.

20. The splash guard as claimed in claim 4, wherein the cover has multiple orifices formed on the cover and communicating with the first aperture of the extension pipe.

* * * * *